US011621135B2

(12) United States Patent
Salinas et al.

(10) Patent No.: US 11,621,135 B2
(45) Date of Patent: Apr. 4, 2023

(54) ARMATURE FOR ELECTROMAGNETIC ACTUATOR, AN ELECTROMAGNETIC ACTUATOR, A SWITCH DEVICE AND A METHOD FOR MANUFACTURING AN ARMATURE

(71) Applicant: ABB Schweiz AG, Baden (CH)

(72) Inventors: Ener Salinas, Västerås (SE); Ara Bissal, Regensburg (DE); Erik Johansson, Västerås (SE); Frederic Tholence, Västerås (SE)

(73) Assignee: ABB Schweiz AG, Baden (CH)

( * ) Notice: Subject to any disclaimer, the term of this patent is extended or adjusted under 35 U.S.C. 154(b) by 47 days.

(21) Appl. No.: 16/634,043

(22) PCT Filed: Aug. 1, 2018

(86) PCT No.: PCT/EP2018/070879
§ 371 (c)(1),
(2) Date: Jan. 24, 2020

(87) PCT Pub. No.: WO2019/025492
PCT Pub. Date: Feb. 7, 2019

(65) Prior Publication Data

US 2021/0066012 A1 Mar. 4, 2021

(30) Foreign Application Priority Data

Aug. 4, 2017 (EP) ..... 17184836

(51) Int. Cl.
*H01H 50/18* (2006.01)
*H01H 49/00* (2006.01)
(Continued)

(52) U.S. Cl.
CPC ..... *H01H 50/18* (2013.01); *H01H 49/00* (2013.01); *H01H 50/44* (2013.01); *H01H 50/546* (2013.01); *H01H 50/641* (2013.01)

(58) Field of Classification Search
CPC ..... H01H 50/18; H01H 50/641
See application file for complete search history.

(56) References Cited

U.S. PATENT DOCUMENTS 3,072,225 A * 1/1963 Long ..... E04C 2/365 52/249
3,646,295 A 2/1972 Circle
(Continued)

FOREIGN PATENT DOCUMENTS

DE 1638424 A1 7/1971
DE 202013105294 U1 1/2014
(Continued)

OTHER PUBLICATIONS

Extended European Search Report Application No. 17184836.9 Completed: Feb. 27, 2018; dated Mar. 7, 2018 6 Pages.
(Continued)

*Primary Examiner* — Alexander Talpalatski
(74) *Attorney, Agent, or Firm* — Whitmyer IP Group LLC

(57) ABSTRACT

An armature for an electromagnetic actuator, the armature including an armature body, at least one electrically conductive member configured for cooperation with a magnetic field generator of an electromagnetic actuator, and a connection end configured for connection of the armature to an apparatus operable by an electromagnetic actuator. The armature body also having a cellular structure. The armature may form part of an electromagnetic actuator, which in turn may be a component in a switch device. The armature may be manufactured by an additive manufacturing process.

17 Claims, 5 Drawing Sheets

(51) Int. Cl.

| | |
|---|---|
| ***H01H 50/44*** | (2006.01) |
| ***H01H 50/54*** | (2006.01) |
| ***H01H 50/64*** | (2006.01) |

(56) References Cited

U.S. PATENT DOCUMENTS

| | | | | |
|---|---|---|---|---|
| 4,952,897 | A * | 8/1990 | Barnel | H01H 3/222 335/147 |
| 5,268,805 | A * | 12/1993 | Peng | G11B 5/5521 360/266 |
| 6,580,345 | B2 | 6/2003 | Akita et al. | |
| 6,760,202 | B1 * | 7/2004 | Meyer | H01F 5/003 361/45 |
| 8,258,419 | B2 | 9/2012 | Jeong et al. | |
| 8,664,558 | B2 | 3/2014 | Bose | |
| 8,791,779 | B2 * | 7/2014 | Jonsson | H01H 50/323 335/121 |
| 9,183,996 | B2 * | 11/2015 | Karlström | H01H 33/6662 |
| 10,181,373 | B2 * | 1/2019 | Mecklenburg | H01F 7/1646 |
| 2008/0006609 | A1 | 1/2008 | Schoenemann et al. | |
| 2013/0027158 | A1 | 1/2013 | Bach et al. | |

FOREIGN PATENT DOCUMENTS

| | | | |
|---|---|---|---|
| DE | 202014010132 | U1 | 4/2015 |
| DE | 102015216749 | A1 | 3/2017 |
| EP | 1054183 | A1 | 11/2000 |
| JP | 2001135206 | A | 5/2001 |
| WO | 2006066420 | A1 | 6/2006 |
| WO | 2009021899 | A1 | 2/2009 |

OTHER PUBLICATIONS

Rodriguez,Vilchis et al: "Experimental Validation of a Finite Element 2D Axial Thomson Coil Model with Indictance and Resistance Compensation", The 13th IET international Conference on AC and DC Power Transmission, Manchester, UK, published Feb. 2017 https://www.researchgate.net/publication/313771512 Site Accessed: Jan. 22, 2020; 7 Pages.

Bissal et al: "Hybrid Multi-Physics Modeling of an Ultra-Fast Electro-Mechanical Actuator" http://www.mdpi.com/2076-0825/4/4/314/htm Site Accessed: Jan. 22, 2020 14 Pages.

International Preliminary Report on Patentabilty Application No. PCT/EP2018/070879 Completed: Jul. 15, 2019 14 Pages.

International Search Report and Written Opinion of the International Searching Authority Application No. PCT/EP2018/070879 Completed: Oct. 1, 2018; dated Oct. 11, 2018 10 Pages.

Wen, Weijie et al: "Research on Operating Mechanism for Ultra-Fast 40.5-kV Vacuum Switches" IEEE Transactions on Power Delivery, vol. 30, Issue No. 6, published Dec. 2015, pp. 2553-2560.

* cited by examiner

ARMATURE FOR ELECTROMAGNETIC ACTUATOR, AN ELECTROMAGNETIC ACTUATOR, A SWITCH DEVICE AND A METHOD FOR MANUFACTURING AN ARMATURE

TECHNICAL FIELD

The present disclosure generally relates to an armature for an electromagnetic actuator. Specifically, the present invention relates to an armature for use in an electromagnetic actuator where operation of the electromagnetic actuator is based on generation of a magnetic force on the armature, e.g. between the armature and a magnetic field generator, e.g. including a coil, so as to effect movement of the armature. Such an electromagnetic actuator can be used in a switch device where operation of the switch device, such as opening and closing of the switch device, is controlled by the actuator. The present disclosure also relates to a method for manufacturing an armature.

BACKGROUND

In power transmission systems, there is a need for fast circuit breakers. Ultra-fast actuators are a new emerging technology that has been used recently as drives when there is a need of high speed actuation. One well known topology of an ultra-fast drive is based on the use of the Thomson coil. A Thomson coil comprises a primary coil that induces a magnetic field, which in turn induces eddy currents in an armature. The Thomson coil has the intrinsic property of generating large impulsive forces that can be used to actuate and promptly separate the current carrying contacts of a high voltage alternating current (HVAC) circuit breaker connected to the actuator.

A circuit breaker of this type may, together with some extra circuitry, be used as DC circuit breaker or a fault current limiter in power transmission systems such as HVDC systems, where a system may be a multi-terminal system comprising a number of converter stations. A circuit breaker operating in a multi-terminal HVDC system or HVDC grid must be able to interrupt fault currents within some milliseconds, typically, less than 5 ms. For a Thomson coil currents in the order of several kilo Amperes are therefore required to generate a magnetic flux density in the order of several Teslas. The product of the induced current densities in the armature together with the radial component of the magnetic flux density produces the required impulsive electromagnetic forces. Due to the high currents and magnetic fields involved, a Thomson coil is often energized through the use of a capacitor bank.

According to one example, the Thomson coil actuator comprises a plunger, or armature, which is displaceable along a displacement direction and which is driven by a Thomson coil. The armature is an electrically conducting member of which a part is adjacent to a coil and this conducting member is subjected to a repulsive force upon application of a current pulse to the coil. The current pulse in the coil generates a varying magnetic flux, which in turn generates a current with opposite direction in the armature, which generates a magnetic force between the coil and the armature for effecting movement of the armature relatively to the coil. Thomson actuators are not limited to actuation of linear movement of the plunger but may in alternative or addition be configured so as to effect or actuate rotational movement of the plunger/armature.

Electromagnetic actuators, e.g. of the Thomson coil type described above, may also be used in other applications where a very fast actuator is useful.

SUMMARY

At present, an armature comprising a continuous aluminum body is commonly used in the concerned type of electromagnetic actuator using a Thomson coil, since it has a relatively good conductivity and also a relatively light but robust structure. If a faster operation is needed, the capacitor bank and the coil both have to be larger. As a consequence the armature has to be larger too, in order to withstand such high energetic impulse, the high forces and the mechanical stresses involved. This results in a bulky and costly system.

Furthermore, the relatively large forces which are generated in relatively short time will result in relatively large accelerations of the plunger or armature, and these accelerations may cause deformation, e.g. bending and/or elongation, of the plunger or armature, which in turn may decrease the efficiency of the actuator.

In order to address at least some of the above concerns and other concerns, an armature, an electromagnetic actuator and a switch device are provided in accordance with the independent claims. A method for manufacturing an armature is also provided.

According to a first aspect is provided an armature for an electromagnetic actuator, the armature comprising:

an armature body, at least one electrically conductive member configured for cooperation with a magnetic field generator of an electromagnetic actuator, a connection end configured for connection of the armature to an apparatus operable by an electromagnetic actuator, wherein the armature body comprises a cellular structure.

By having an armature structure with an armature body that comprises a cellular structure is obtained the advantage of the possibility of having a light structure for the armature body. A lighter armature body structure implies reduction of the capacitor bank size when used in an actuator and thereby cost savings. The cellular configuration will also use less material for the armature and thereby reduce costs. A light armature will also improve ultra-fast actuation, when used in an actuator. Faster actuation implies increasing the reliability of the system it is aiming to protect (e.g. HVDC expensive air-core reactors).

A cellular structure may also be described as an array of hollow cells. The cellular structure may at least partly be an open cellular structure, but it may also be a closed cellular structure in that the cellular structure may be enclosed, e.g. in some type of housing or similar, or having particular walls that closes the open cells.

The cellular structure may for example be made in titanium or titanium alloy in order to obtain a very light structure, which at the same time is very robust and strong. It has e.g. been found that TiAl6V4 will make it possible to obtain a very strong and robust cellular structure for the armature body. Other examples of materials are aluminum, carbon fiber, graphene, polymer.

The armature may comprise a cellular structure that comprises cellular walls configured to take up and/or distribute forces and stresses within the armature. This configuration has the advantage of functioning as a reinforcement of the structure with regard to forces and stresses that are generated by the repulsion force when the armature is used in an electromagnetic actuator. The forces and stresses will then be distributed within the armature, through the walls.

The armature may be configured to be movable in at least one direction of movement when the armature is mounted in an electromagnetic actuator, and wherein the cellular structure comprises cellular walls extending essentially in the at least one direction of movement. Since a large part of the forces and stresses are directed in the direction of movement, this configuration has the advantage of functioning as a reinforcement of the structure with regard to forces and stresses that are generated by the repulsion force when the armature is used in an electromagnetic actuator.

The armature may comprise a central axis and the armature being configured to be movable in a direction of the central axis when the armature is mounted in an electromagnetic actuator, and wherein the cellular structure comprises cellular walls extending essentially in the axial direction. This configuration displays the same advantage as described above.

It may also be contemplated to have cellular walls that are somewhat inclined in the relation to the direction of movement/the axial direction of the armature.

The cellular structure may for example be a honeycomb structure. A honeycomb structure usually comprises hexagonal cells, but the thickness of the cellular walls may vary. E.g. the walls may be somewhat thicker at and towards the wall intersections such that the cells can be close to having a circular shape. Honeycomb structures have the advantage of being light and at the same time being able to withstand significant forces and stress, particularly in the longitudinal/axial direction of the cells. However, also other cellular structures may be contemplated, e.g. lattice structure, mesh structure. Generally, the cells of the cellular structure may have many different geometrical shapes, e.g. polygonal, triangular, circular, etc.

The cellular structure may comprise cells having a diameter of 2 mm-20 mm. Preferably 4 mm-10 mm. The size of the cells may be adapted to the circumstances of use.

The cellular structure may comprise cells having a wall thickness of 0.05 mm-1.0 mm. Preferably of 0.1 mm-0.5 mm. The cellular walls may have varying thickness depending on the circumstances of use. In particular, the cellular walls may have a thickness that increases at the intersection of walls. This will provide for an increased ability to withstand forces and stress.

The cellular structure having a density of cells of between 0.5 cells/$cm^2$ and 6 cells/$cm^2$.

The armature body may comprise an armature housing configured to at least partly surround the cellular structure. Such an armature housing will have a stabilizing and/or reinforcing effect on the structure. Preferably, the armature body will comprise an armature housing at the locations where the electrically conductive member is located. Generally, the armature can be described as having two main sides; one first side on which is located the connection end of the armature and which side may be referred to as the connection side, and a second side that is opposite the connection side. An electrically conductive member may be located on either one of these sides or on both sides. The armature housing may comprise a first wall part that covers at least a part of the cellular structure at the above referred to second side. In most cases, it would be preferable that the first wall part covers the entire cellular structure at the second side of the armature. The armature housing may also comprise a second wall part that forms a side wall to the cellular structure, at essentially a right angle to the first wall part. The first and second wall parts may be connected. The armature housing may also, or as an alternative to the second wall part on the second side, comprise a third wall part that covers at least a part of the cellular structure on the first, connection side of the armature. The housing is preferably made in the same material as the cellular structure, and they may be made in one and the same manufacturing process, which would be an advantage. The armature housing usually has thicker walls than the cellular walls of the cellular structure. E.g. at a ratio of approximately 10:1. The armature housing is mainly designed to hold and/or support the cellular structure and it may also be designed to hold the electrically conductive member when this member is located where there is a housing. The housing will contribute to transmitting the high forces and stresses, generated upon activation of the actuator, to the cellular structure.

The at least one electrically conductive member may be at least partly embedded in the armature housing. It may be embedded by forming an integral part of the housing or as a separate part embedded in the housing as will be explained later.

The armature may have an armature body that has a central axis and a delimiting external contour, and wherein, for at least a portion of the armature body, a distance between the central axis and the external contour decreases in the axial direction and in a direction towards the connection end of the armature. This shape has been found to be efficient by providing a strong structure with a minimum of material.

The armature may have at least one side that has a flat portion that is perpendicular to a central axis of the armature and wherein the at least one electrically conductive member is located on or in said flat portion. The flat portion may be made as a part of the armature housing, which part is configured to receive and house an electrically conductive member. This at least one side that has the mentioned flat portion may be located on either one of the above described first connection side or the second side.

The armature may have two electrically conductive members configured for cooperation with a respective magnetic field generator of an electromagnetic actuator, wherein the armature has two opposing sides that have a respective flat portion perpendicular to a central axis of the armature, and wherein it has an electrically conductive member located on or in the respective flat portion. When the armature has this configuration with two electrically conductive members, it may be used both in connection with an actuator that provides both an opening function and a closing function with regard to a contact, e.g. in a switch device such as a current interrupter. Further, when the armature has two opposing sides that have a respective flat portion, one of the sides having a flat portion would then be the above described first connection side and the other side having a flat portion would be the above described the second side.

The at least one electrically conductive member may be attached to the armature body. The at least one electrically conductive member is then a separate member and this will make it possible to manufacture the armature body in a non-electrically conductive material, e.g. a polymer material. However, the armature body may of course also be manufactured in an electrically conductive material, e.g. titanium or titanium alloy, as have been mentioned above. The at least one electrically conductive member may be configured as a ring-shaped plate. A great advantage is obtained in that the electrically conductive material of the electrically conductive part, which electrically conductive material, e.g. copper or silver, is relatively heavy, only has to be used in the electrically conductive part. The rest of the armature may be made in a different and much lighter material. Other materials that may be used for the electrically conductive part are gold, aluminum.

Alternatively, in the case that the armature body as such is made of an at least partly electrically conductive material, then the at least one electrically conductive member may be configured as an integral part of the armature body. The electrically conductive member may e.g. be configured as part of an armature housing. Examples of such materials that may be used for such an armature body with integrated electrically conductive member are titanium or titanium alloy, aluminum, carbon fiber, and graphene.

The armature may comprise a connection part that may be configured as a channel in the armature body, said channel having an opening at the connection end of the armature, and which connection part is configured for connection of the armature to an apparatus operable by an electromagnetic actuator. The channel may then have a channel wall, and said channel wall may form part of the armature housing. The channel wall will then function as a reinforcement for the armature in the axial direction.

The electrically conductive member may be configured for cooperation with a magnetic field generator comprising a repulsion coil.

The cellular structure of the armature body may comprise intermediate walls extending in an essentially perpendicular direction in relation to the previously described cellular walls. The cellular structure can then be described as a layered structure where the intermediate walls divide the cellular structure, having mainly vertical/axial cellular walls, into horizontal layers. The generated repulsion force results in forces and stresses that are distributed in the armature not only in the axial direction, or direction of movement, but there are usually also components of the forces and stresses in a direction perpendicular to the direction of movement, i.e. radial components when the direction of movement is axial. These intermediate walls contribute to distribute forces and stresses in the radial direction of the armature and have a reinforcing function.

According to a second aspect is provided an electromagnetic actuator comprising an armature as described in any one of the examples above, and further comprising at least one magnetic field generator, and an electricity source connectable to the magnetic field generator.

The at least one magnetic field generator of the electromagnetic actuator may comprise a repulsion coil. For example it may comprise a Thomson coil. This would make it useful in, for example, a switch device, such as a circuit breaker, a current interrupter or other switching equipment.

According to a third aspect is provided a switch device comprising:

at least a first electric contact element and a second electric contact element which can be selectively connected and disconnected with each other such that when the first and second contact elements are connected the switch device is closed, and when the first and second contact elements are disconnected the switch device is opened, and wherein one of said contact elements is movable, an electromagnetic actuator as described in anyone of the examples above, a pullrod having a first end connected to the connection end of the armature of the electromagnetic actuator and having a second end connected to the movable contact element such that the opening or closing of the switch device is controllable by the electromagnetic actuator. A switch device having an electromagnetic actuator with an armature as described above will have the advantages of being light, ultra-fast and less expensive than prior art devices.

According to a fourth aspect is provided a method for manufacturing an armature as described above, comprising an additive manufacturing process step of at least a part of the armature. An additive manufacturing method, such as 3D printing, is a very efficient and cost effective method of manufacturing an armature body with a cellular structure. The armature body can be made in any metal alloy (non-magnetic) with a high strength to density ratio. The armature body may for example be printed in titanium or titanium alloy in order to obtain a very light structure, which at the same time is very robust and strong, e.g. TiAl6V4. An example of one method is selective laser melting. Another example of a method is electron beam melting. Alternatively, the armature body may be manufactured in graphene or a polymer. In particular, the cellular structure may be manufactured in an additive manufacturing process step. The method may also comprise that the housing is manufactured in such a process and preferably in the same process step. It is also conceivable that the electrically conductive member may be manufactured in an additive manufacturing process step.

According to a fifth aspect is provided a method for manufacturing an armature for an electromagnetic actuator, comprising an additive manufacturing process step of at least a part of the armature. This method can be used for many other types of armatures then the armature described in detail in the present disclosure.

Further advantages and details will be described in the following detailed description of examples. However, many modifications and alterations may be foreseen without departing from the scope defined in the appended patent claims.

BRIEF DESCRIPTION OF THE DRAWINGS

The invention will now be described in more detail, with reference being made to the enclosed schematic drawings illustrating different aspects and embodiments of the invention, given as examples only, and in which.

DETAILED DESCRIPTION

Figure 1:
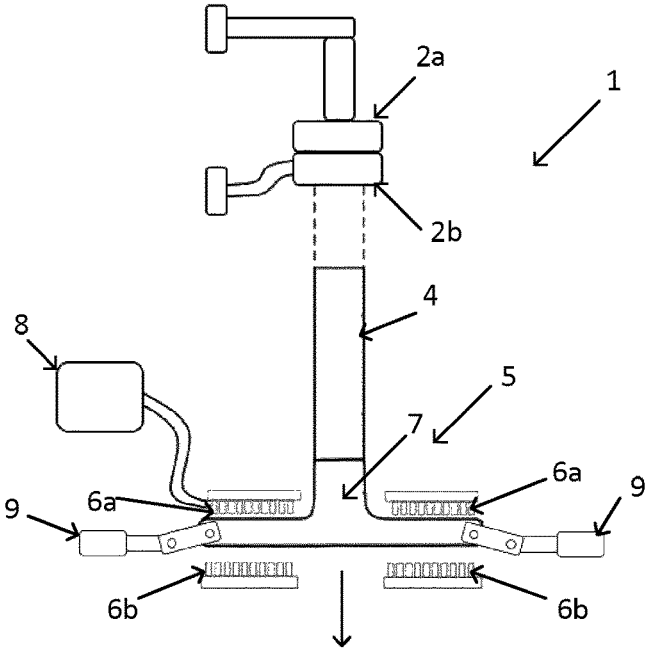
PRIOR ART Fig. 1
FIG. 1 shows a circuit breaker with a Thomson coil electromagnetic actuator according to prior art.

In FIG. 1 is schematically illustrated an example of a circuit breaker 1 as is known from prior art and in which a Thomson coil is used to generate a large impulsive force. It may for example be a HVDC breaker. The mechanical part of the circuit breaker comprises a contact system, a pullrod, an ultra-fast actuator (often also called drive) and a control unit. Normally the circuit breaker is enclosed in an enclosure containing an insulating medium. The contact system comprises a pair of current carrying contacts 2*a*, 2*b*, of which one is a movable contact 2*b* and one is a stationary contact 2*a*. A pullrod 4 connects the contact system to the actuator 5. The pullrod is made of an electrically insulating material in order to electrically insulate the contacts from the actuator. The actuator comprises an electrically conductive armature 7, an opening coil 6*a* and a closing coil 6*b* which are connected to an electricity source. The opening coil 6*a* would conventionally be connected to a capacitor bank 8, as an electricity source. The closing coil may also be connected to the capacitor bank. The coils are e.g. flat multi-turn spiral coils, such as Thomson coils. This is thus an example of an electromagnetic actuator. Spring biased bistable contacts 9 are used to keep the armature 7 in close contact with the opening coil 6*a* or the closing coil 6*b*.

The armature 7 is made of an electrically conducting material. When a fault current occurs, the control unit is triggered so that the breaker's actuator can separate the contacts within a few hundreds of a microsecond. This is done by discharging the capacitor bank 8 connected to the opening coil 6*a*, which will result in a large current surge in the coil that in turn generates a substantial varying magnetic field. Eddy-currents are generated in the armature 7, in the opposite direction, which will result in an repulsive force impulse that will move the armature 7 away from the coil 6*a*, in a downwards direction shown by the arrow in FIG. 1. The contacts 2*a* and 2*b* will thus by separated when the movable contact 2*b* is moved downwards by the armature 7 and the pullrod 4. Since the circuit breaker in FIG. 1 is also provided with a closing coil 6*b*, the armature 7 will come to a stop against the closing coil. In order to close the contacts again, the closing coil 6*b* can be activated such that the armature 7 and the pullrod 4 moves upwards and thereby moves the movable contact 2*b* into contact with the stationary contact 2*a* and thereby closing the electric circuit.

Figure 4:
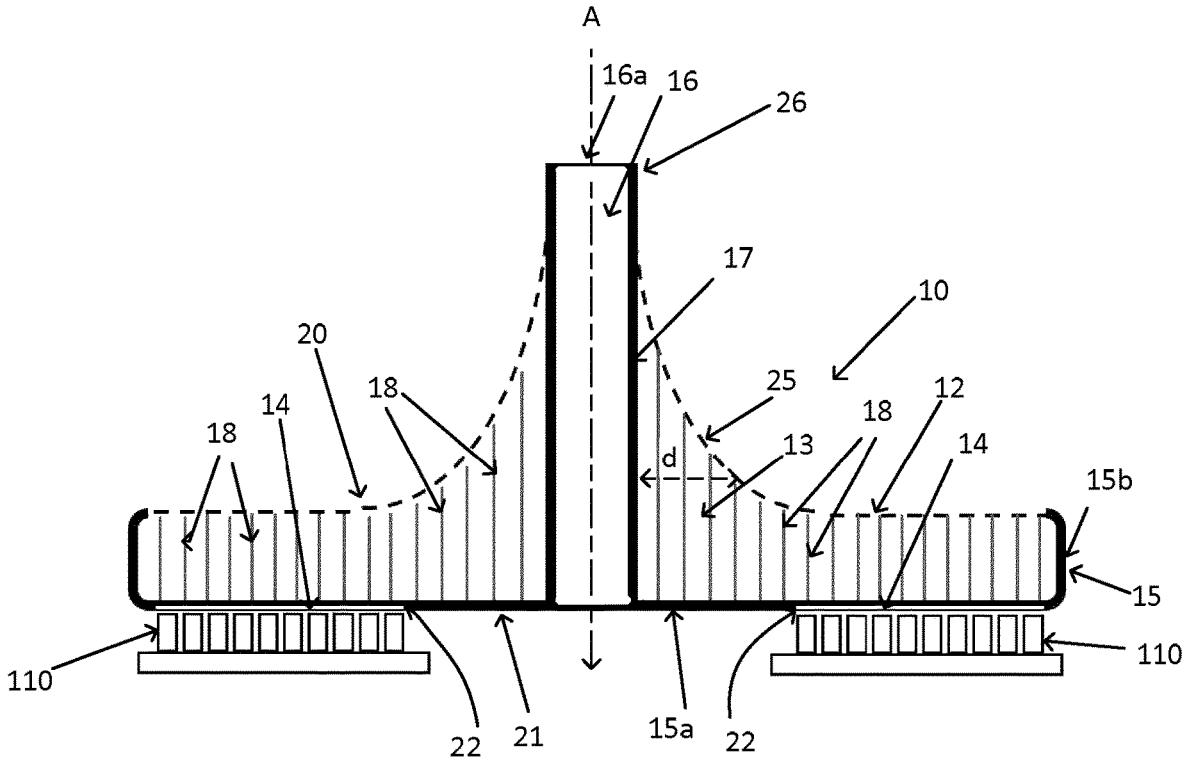
FIG. 4 illustrates schematically a cross-section of the armature in FIG. 2.
Figure 2:
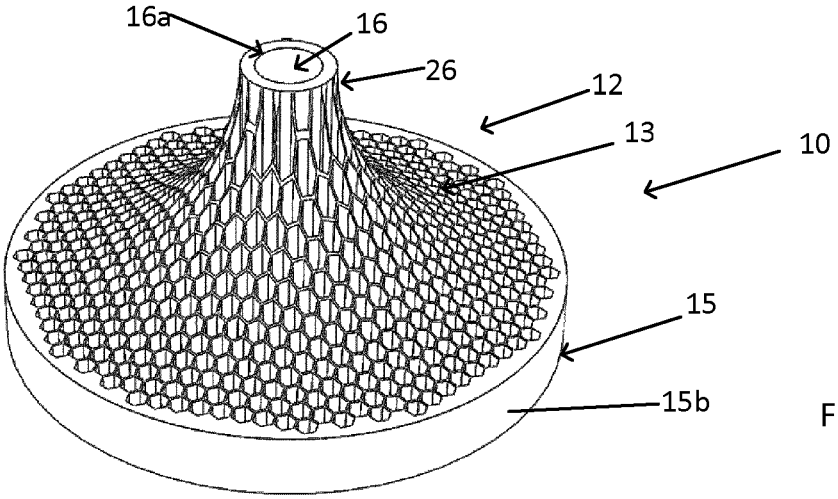
FIG. 2 is a schematic perspective view showing a first example of an armature.
Figure 5:
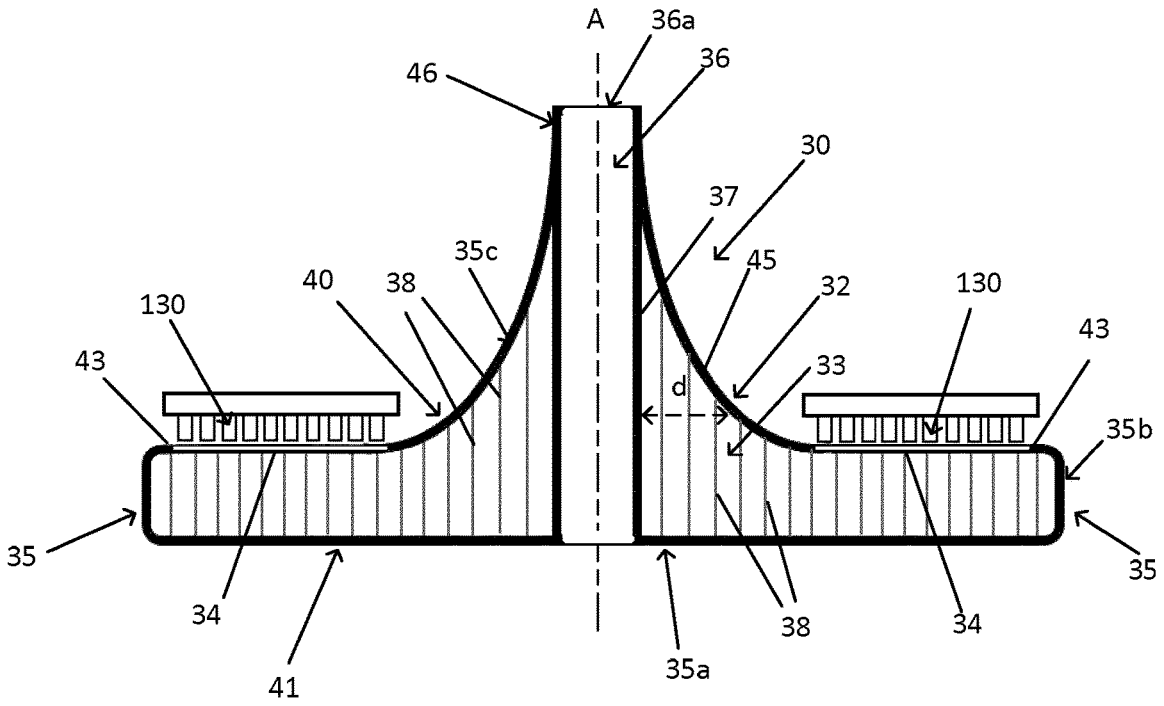
FIG. 5 illustrates schematically a second example of an armature.
Figure 6:
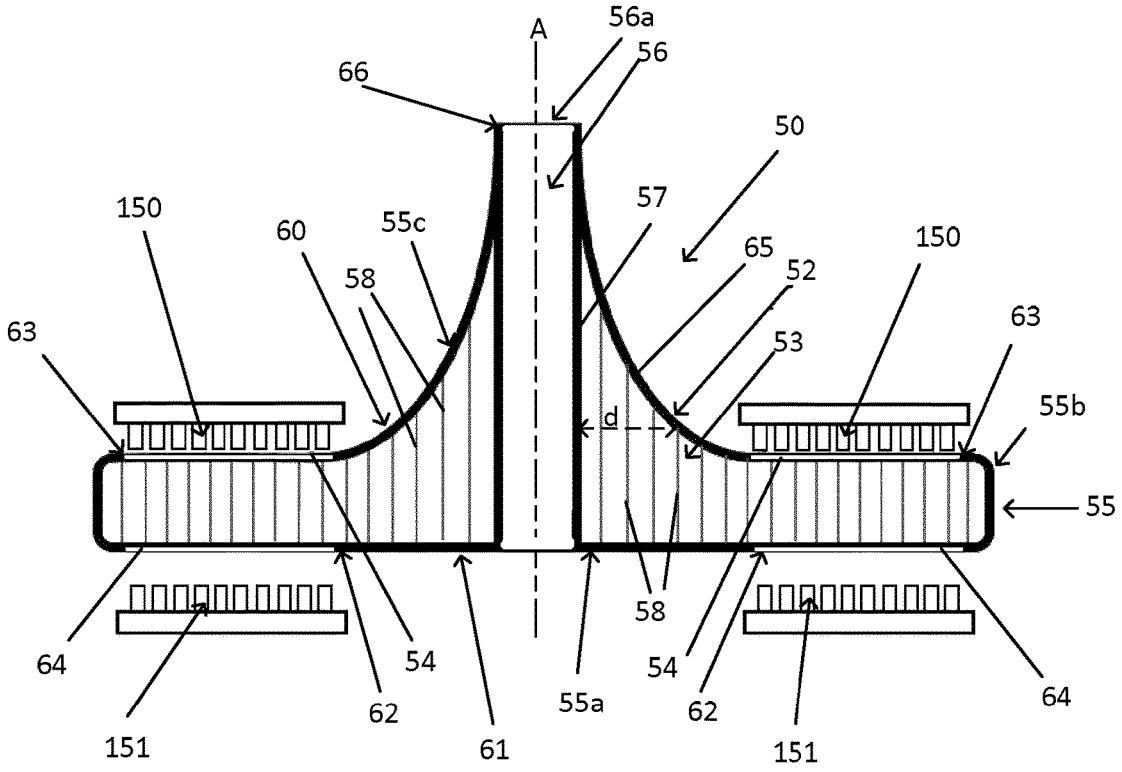
FIG. 6 illustrates schematically a third example of an armature.

In FIGS. 2, 3, 4, 5 and 6 are schematically illustrated examples of an armature 10, 30, 50 according to the present disclosure. FIG. 4 shows a cross-section of the armature shown in FIG. 2, and FIGS. 5 and 6 show cross-sections of alternative examples of an armature. The armature may e.g. be an armature for an electromagnetic actuator, such as a Thomson coil actuator. The armature 10, 30, 50 comprises an armature body 12, 32, 52, at least one electrically conductive member 14, 34, 54, 64 configured for cooperation with a magnetic field generator of an electromagnetic actuator, and a connection end 26, 46, 66 configured for connection of the armature to an apparatus operable by an electromagnetic actuator. The armature body 12, 32, 52 comprises a cellular structure 13, 33, 53. In FIGS. 4, 5 and 6 is also schematically illustrated a magnetic field generator 110, 130, 150, 151 with which the respective electrically conductive member 14, 34, 54, 64 is configured to cooperate.

Generally, the cellular structure 13, 33, 53 may comprise cellular walls 18, 38, 58 that are configured to take up and/or distribute forces and stresses within the armature 10, 30, 50. Forces and stresses are generated by the repulsive force impulse that results when the armature is used in an electromagnetic actuator and in e.g. a switch device, as described above.

An example of a cellular structure 13, 33, 53 of the armature body 12, 32, 52 can be more clearly seen in the perspective view of FIG. 2. The illustrated cellular structure 13 is a partly open cellular structure. It may be described as comprising an array of hollow cells. The cellular structure may for example be a honeycomb structure. A honeycomb structure usually comprises hexagonal cells, but the thickness of the cellular walls may vary such that the cells can be close to having a circular shape. The armature body in any one of the examples in this disclosure can comprise such a cellular structure. Other geometric shapes of the cells may also be foreseen, even when the cellular structure itself has the general structure of a honeycomb structure.

The armature 10, 30, 50 is configured to be movable in at least one direction of movement when the armature is mounted in an electromagnetic actuator. Since the repulsion forces that are generated upon activation of the electromagnetic actuator affect the armature to move in a certain direction of movement, it is an advantage if the cellular structure 13, 33, 53 comprises cellular walls 18, 38, 58 that extend essentially in the at least one direction of movement, in order to take up and/or distribute forces and stresses within the armature and have a strong cellular structure and a strong armature. In the examples illustrated in FIGS. 2, 4, 5 and 6, the armature 10, 30, 50 comprises a central axis A and the armature 10, 30, 50 is configured to be movable in a direction of the central axis, i.e. in the axial direction along the central axis, when the armature is mounted in the electromagnetic actuator. The cellular structure then comprises cellular walls 18, 38, 58 extending essentially in the axial direction. However, it may also be conceivable to have cellular walls that are somewhat inclined in relation to the direction of movement/the axial direction.

In the shown examples of FIGS. 2-6, the armature 10, 30, 50 has at least one side 21, 40, 60, 61 that has an essentially flat portion 22, 43, 62, 63, which flat portion is essentially perpendicular to a central axis A of the armature, and the at least one electrically conductive member 14, 34, 54, 64 is located on or in said respective flat portion.

In the example shown in FIG. 6, the armature 50 has two electrically conductive members 54, 56 configured for cooperation with a respective magnetic field generator of an electromagnetic actuator. The armature 50 then has two opposing sides 60, 61 that have a respective essentially flat portion 63, 62 perpendicular to a central axis A of the armature, and it has an electrically conductive member 54, 64 located on or in the respective essentially flat portion 63, 62.

Generally, the armature can be described as having two main sides; a first side 20, 40, 60 on which is located the connection end 26, 46, 66 of the armature and which side may therefore be referred to as the connection side, and a second side 21, 41, 61 that is opposite the connection side. Based on the views in the figures, the first side 20, 40, 60 can also be referred to as the upper side and the second side 21, 41, 61 may then be referred to as the bottom side.

In the shown examples, the at least one electrically conductive member 14, 34, 54, 64 is attached to the armature, or rather to the armature body 12, 32, 52. This can be achieved in many ways. For example the electrically conductive member may be sunken into the flat portion 22, 43, 62, 63. The flat portion may then comprise a recess made in the armature/armature body, and the shape of the recess is made such that the electrically conductive member will fit snugly in the recess. When the electrically conductive member has been secured at its location, the electrically conductive member will form part of the flat portion of the concerned side of the armature. The electrically conductive member may be secured by mechanical means or it may be bonded to it, e.g. at a molecular level. Alternatively, if the armature body 12, 32, 52 is made of an at least partly electrically conductive material the at least one electrically conductive member 14, 34, 54, 64 can be configured as an integral part of the armature body 12, 32, 52.

As schematically shown in FIGS. 2-6, the armature body 12, 32, 52 may comprise an armature housing 15, 35, 55 configured to at least partly surround the cellular structure 13, 33, 53. Preferably, the armature body 12, 32, 52 will comprise an armature housing 15, 35, 55 at the locations where the electrically conductive member 14, 34, 54, 64 is located. An electrically conductive member may be located on either one of the above described first connection side or the second side, or on both sides. Preferably, the armature housing comprises a first wall part 15*a*, 35*a*, 55*a* that covers at least a part of the cellular structure 13, 33, 53 at the second side 21, 41, 61 of the armature. In most cases, and as illustrated in FIGS. 4-6, it would be preferable that the first wall part 15*a*, 35*a*, 55*a* covers the entire cellular structure at the second side of the armature. The armature housing then preferably also comprises a second wall part 15*b*, 35*b*, 55*b*, connected to the first part, and which second wall part covers the lateral sides of the cellular structure 13, 33, 53, i.e. the sides that are essentially extending in the axial direction and which connect the first side with the second side at the outer rim of the armature. The armature housing may also, or as an alternative to the second wall part on the second side, comprise a third wall part 35*c*, 55*c* that covers at least a part of the cellular structure on the first, connection side 40, 60 of the armature, as is illustrated in FIGS. 5 and 6. In FIGS. 2 and 4 is illustrated an example where the connection side 20 is not covered by a housing wall, but instead the cellular structure is open. The armature housing 15, 35, 55 will have a stabilizing and/or reinforcing effect and it may very well be manufactured in one piece with the cellular structure. The armature housing usually has thicker walls than the cellular walls 18, 38, 58 of the cellular structure. E.g. at a ratio of approximately 10:1. The armature housing 15, 35, 55 is designed to hold and/or support the cellular structure 13, 33, 52, and it may also be designed to hold the electrically conductive member 14, 34, 54, 64, when this member is located where there is a housing. The housing will then contribute to transmitting the high forces and stresses, generated upon activation of the actuator, to the cellular structure.

The at least one electrically conductive member 14, 34, 54, 64 may be at least partly embedded in the armature housing 15, 35, 55. It may be embedded by forming an integral part of the housing or as a separate part embedded in the housing as will be explained later.

The first, connection side 20, 40, 60 of the armature may have a special shape, of which an example is illustrated in the FIGS. 2, 4-6. The armature body 12, 32, 52 has a central axis A and a delimiting external contour 25, 45, 65, and, as an example, for at least a portion of the armature body, a distance d between the central axis A and the external contour 25, 45, 65 decreases in the axial direction and in a direction towards the connection end 26, 46, 66 of the armature. The external contour may be curved. At least part of the delimiting surface in the axial direction may then be a negatively curved surface as illustrated in the figures. The curve may e.g. be part of a parabolic curve or hyperbolic curve.

The armature may have different geometrical shapes depending on the chosen manufacturing process and depending on the design of the cellular structure. In an alternative way of describing the armature body, the armature body 12, 32, 52 has a central axis A and is shaped as a rotational symmetry body with a radius extending from the central axis to a delimiting curve of the rotational symmetry body, and wherein at least a portion of the armature body has a delimiting curve with a radius that decreases in the axial direction and in a direction towards the connection end 26, 46, 66 of the armature body. The curve may e.g. be part of a parabolic curve or hyperbolic curve. Generally, an advantageous shape of the armature body, and in particular the delimiting curve or contour, can be determined by using numerical techniques, such as the Finite Element Method (FEM), in which the mechanical stresses can be computed based on an initial current impulse given by the Thomson coil.

It should also be mentioned that the armature could e.g. have a basically square shape.

The armature described in the examples above can form part of an electromagnetic actuator 100. Such an electromagnetic actuator would also comprise at least one magnetic field generator 110, 130, 150, 151 and an electricity source 105 that is connectable to the magnetic field generator. Examples of an electromagnetic actuator 100 are schematically shown in FIGS. 7, 8, 9*a* and 9*b*, in which it is shown as a part of a switch device 200 that represents an apparatus operable by the electromagnetic actuator. The electricity source 105 may for example comprise a capacitor bank.

The switch device 200 comprises at least a first electric contact element 201 and a second electric contact element 202. These contacts can be selectively connected and disconnected such that when the first and second contact elements are connected the switch device 200 is closed, and when the first and second contact elements are disconnected the switch device is opened. In order to achieve this, at least one of the contacts is movable. In the illustrated examples the second contact element 202 is movable. The switch device further comprises an electromagnetic actuator 100 as described below, and having an armature as described in any one of the examples above. The switch device also comprises a pullrod 107 having a first end 108 connected to the connection end 26, 46, 66 of the armature of the electromagnetic actuator and having a second end 109 configured for connection to the movable second contact element 202 such that the opening or closing of the switch device is controllable by the electromagnetic actuator. Thus the armature 10, 30, 50 is connectable to the switch device via the pullrod 107. The pullrod 107 is made of a non-electrically conducting material. A switch device would normally also include some type of control unit that would control the activation of the electromagnetic actuator, but such a control unit can be of any known type and is not shown in the figures.

Figure 7:
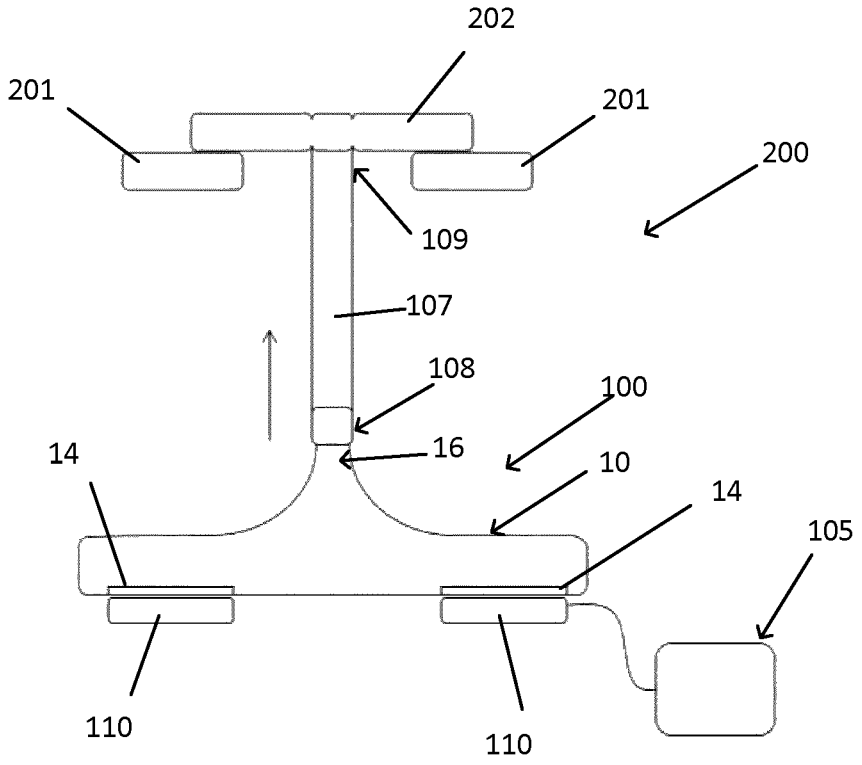
FIG. 7 illustrates schematically a first example of a switch device with a first example of an electromagnetic actuator.

In FIG. 7 is shown a switch device 200 as described above and having an electromagnetic actuator 100 comprising an armature 10 as shown in FIG. 4, and said armature having an electrically conductive member 14 on its bottom side 21. The actuator 100 further has a magnetic field generator 110, e.g. Thomson coil. When a repulsive impulse is generated by the magnetic field generator 110, the armature 10 is moved upwards and the second contact element 202 is then moved upwards such that the contacts 201, 202 are opened and the circuit is broken.

Figure 8:
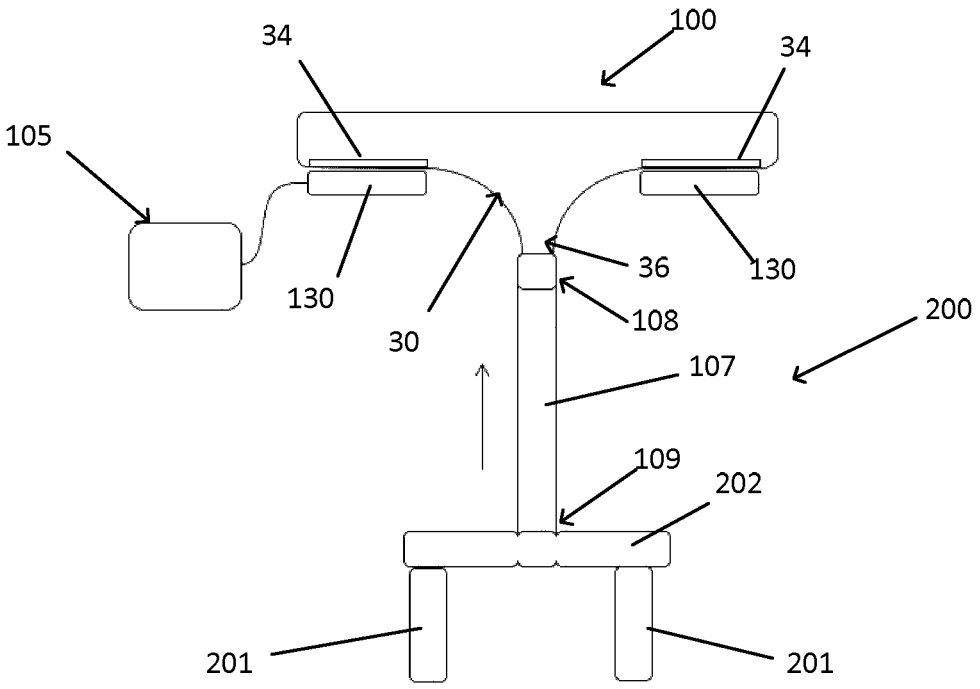
FIG. 8 illustrates schematically a second example of a switch device with a second example of an electromagnetic actuator.

In FIG. 8 is shown a switch device 200 as described above and having an electromagnetic actuator 100 comprising an armature 30 as shown in FIG. 5, and said armature having an electrically conductive member 34 on what is referred to as its upper side 40 above; i.e. the connection side facing towards the contacts 201, 202. The actuator 100 further has a magnetic field generator 130, e.g. Thomson coil. When a repulsive impulse is generated by the magnetic field generator 130, the armature 30 is moved upwards and the second contact element 202 is then moved upwards such that the contacts 201, 202 are opened and the circuit is broken.

Figure 9A:
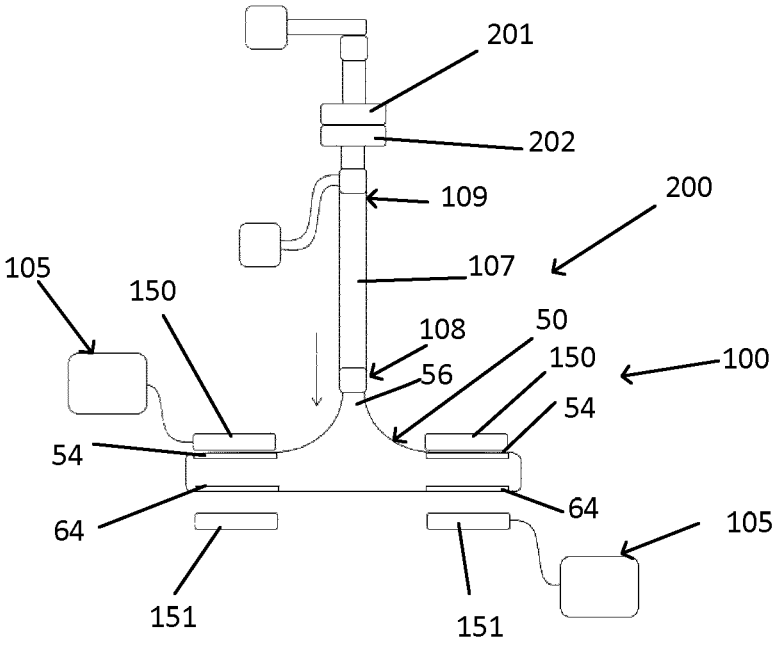
FIGS. 9*a* and 9*b* illustrate schematically a third example of a switch device with a third example of an electromagnetic actuator.
Figure 9B:
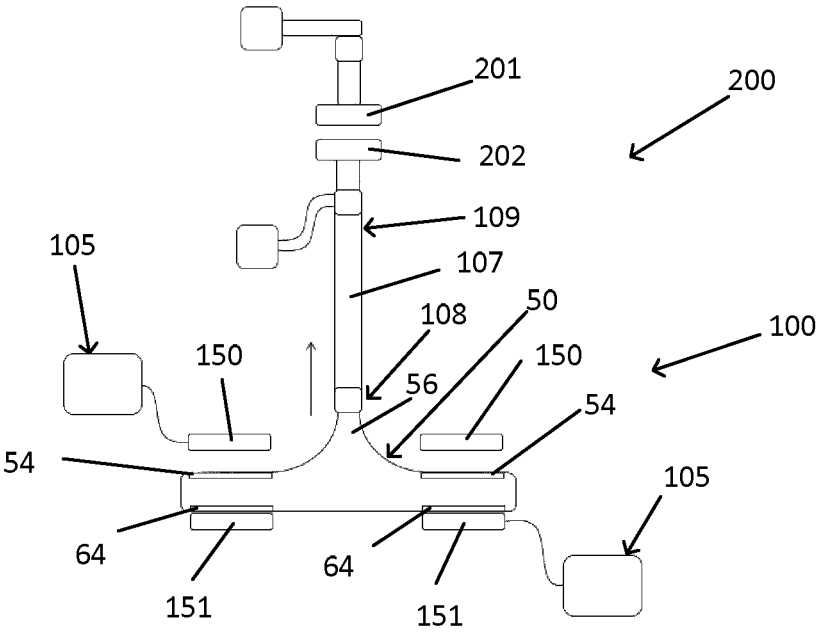

In FIGS. 9*a* and 9*b* is shown a switch device 200 as described above and having an electromagnetic actuator 100 comprising an armature 50 as shown in FIG. 6. The armature has two electrically conductive members 54, 64. One electrically conductive member 54 on what is referred to as its upper side above; i.e. the connection side facing towards the contacts 201, 202, and one electrically conductive member 64 on its bottom side. The actuator 100 further has two magnetic field generators 150, 151, e.g. Thomson coils. One coil 150 for opening the contacts 201, 202 of the switch device 200 and thus opening/breaking the electric circuit, and another coil 151 that is used for closing the contacts 201, 202 of the switch device 200 and thus closing the electric circuit. When a repulsive impulse is generated by the magnetic field generator 150, the armature 50 will move downwards, as indicated by the arrow in FIG. 9*a*, and the second contact element 202 will then move downwards such that the contacts 201, 202 will open and the circuit will be broken, as is illustrated in FIG. 9*b*. When a repulsive impulse is generated by the magnetic field generator 151, the armature 50 will move upwards, as indicated by the arrow in FIG. 9*b*, and the second contact element 202 will then move upwards such that the contacts 201, 202 will close and the circuit will be closed again, as is illustrated in FIG. 9*a*.

In FIGS. 7 and 8 is not illustrated any device for closing the contacts again. Since the closing of the contacts, and closing of the circuit, is not an operation that will have to be executed in an extremely short time, other types of devices than a Thomson coil may be used for the closing function. The actuators in FIGS. 7-9 may also be provided with bistable contacts in order to provide close contact between the electrically conductive member of the armature and the magnetic field generator, e.g. a Thomson coil, or other types of devices with similar function.

In addition to the elements and features described above, the following individual elements and features, as described below, may be individually added and combined with anyone of the above described elements and features taken separate or in combination.

The armature may comprise a connection part 16, 36, 56 for connection of the armature to an apparatus operable by an electromagnetic actuator, e.g. for connection of a pullrod. The connection part of the armature can be configured as a channel 16, 36, 56 in the armature body, with a centrally located opening 16*a*, 36*a*, 56*a* at the connection end 26, 46, 66 of the armature, into which opening a pullrod 107 can be inserted and secured. The wall 17, 37, 57 of the channel may form part of the armature housing 15, 35, 55. The channel wall will then be connected to the armature housing at the connection side 20, 40, 60 of the housing or at the opposing second side 21, 41, 61 of the housing, or on both sides. The channel may then extend all the way through the armature body, from the connection side to the opposing second side. As mentioned before with regard to the housing, the channel would then be configured with thicker walls than the cellular walls 18, 38, 58 of the cellular structure. E.g. at a ratio of 10:1. The channel preferably has a shape corresponding to the shape of the pullrod 107 and it should connect firmly to the pullrod. There may also be a particular connection device located in the channel by means of which the pullrod can be connected to the armature. A common connection arrangement for this purpose would be a screw/thread arrangement. The channel wall may very well be manufactured in one piece with the cellular structure, and will have a stabilizing and/or reinforcing effect.

Figure 3:
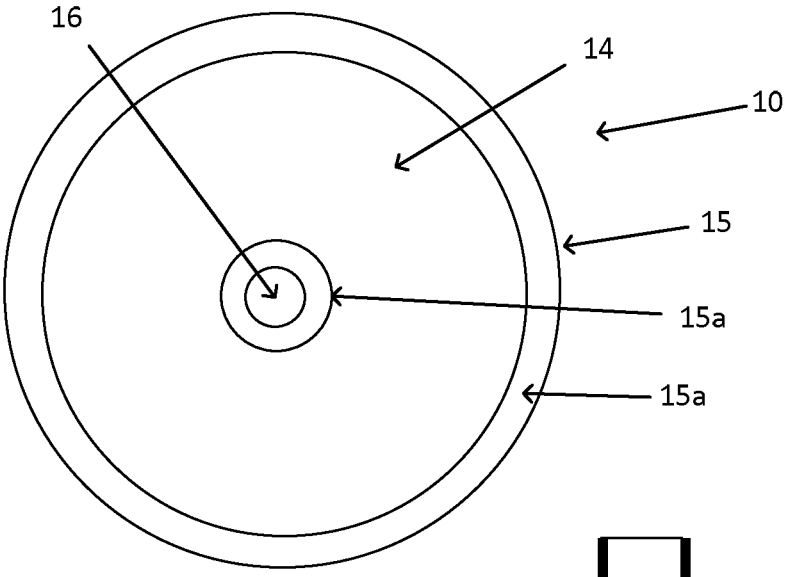
FIG. 3 shows schematically a bottom side of the armature in FIG. 2.

As shown in particular in FIG. 3, the electrically conductive member 14 can have the shape of a plate and in particular a plate having an annular shape. This is also applicable to all examples of the electrically conductive member 14, 34, 54, 56. When the electrically conductive member is located in a part of the armature housing or other part of the armature body, it has a free outwards directed surface that faces the magnetic field generator. The electrically conductive member may e.g. be made of copper or silver. In the example shown in FIG. 3, the electrically conductive member 14 is located in the housing part 15*a* of the bottom side 21 of the armature 10, as also shown e.g. in FIG. 4.

The magnetic field generator 110, 130, 150, 151 of the electromagnetic actuator is preferably a repulsion coil, such as a Thomson coil. It is preferably a flat multi-turn spiral coil.

Generally, the cellular structure may be an at least partly open cellular structure, as shown in FIGS. 2 and 4, or it may be a closed structure, being surrounded by external walls, e.g. walls of the armature housing, as shown in FIGS. 5 and 6. It may also be described as an array of hollow cells. It has also been illustrated, as an example, as being a honeycomb structure. However, also other cellular structures may be contemplated, e.g. lattice structure, mesh structure. The cells of the structure may have many different geometrical shapes, e.g. polygonal, triangular, circular, etc.

At least a part of the armature body is advantageously manufactured by using an additive manufacturing process, such as 3D printing, and from that method other cellular structures may be possible. For example a manufacturing process involving selective laser melting may be used. The armature body with the cellular structure may be made using titanium or a titanium alloy as a suitable material. Other materials may include graphene and polymers.

The cellular structure may comprise cells having a diameter of 2 mm-20 mm. Preferably 4 mm-10 mm.

The cellular structure may comprise cells having a wall thickness of 0.05 mm-1.0 mm. Preferably of 0.1 mm-0.5 mm. The walls of the cells may have a thickness that increases at the intersection of walls.

The cellular structure may have a density of cells of between 0.5 cells/cm$^2$ and 6 cells/cm$^2$.

Figure 10:
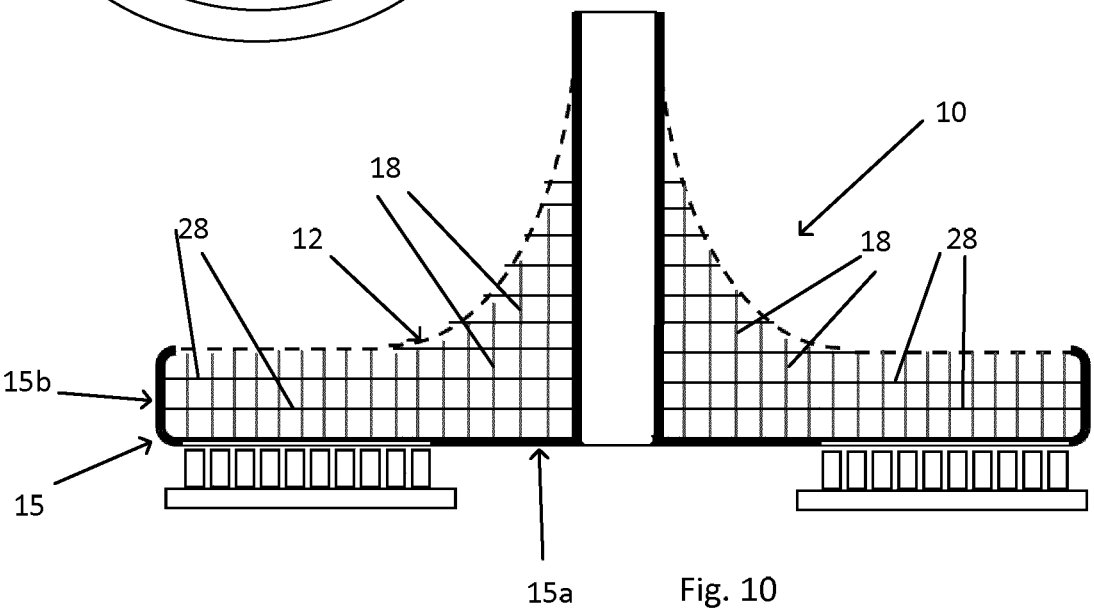
FIG. 10 illustrates schematically another example of an armature.

The generated repulsion force results in forces and stresses that are distributed in the armature not only in the axial direction, or direction of movement, but there are usually also components of the forces and stresses in a direction perpendicular to the direction of movement, i.e. radial components when the direction of movement is axial. As schematically illustrated in FIG. 10, and in order to provide reinforcement in the radial direction, the cellular structure 13 of the armature body 12 may comprise intermediate walls 28 extending in an essentially perpendicular direction in relation to the previously described cellular walls 18. The cellular structure can then be described as a layered structure where the intermediate walls divide the cellular structure, having mainly vertical/axial cellular walls, into horizontal layers. The variant of cellular structure shown in FIG. 10 is based on the armature example shown in FIGS. 2-4, but it would also be possible to use as cellular structure in the other examples of FIGS. 5 and 6.

The disclosure also concerns a method for manufacturing an armature 10, 30, 50 as described above, comprising an additive manufacturing process step of at least a part of the armature.

The disclosure also concerns a method for manufacturing an armature for an electromagnetic actuator, comprising an additive manufacturing process step of at least a part of the armature. This method can be used for many other types of armatures then the armature described in detail in the present disclosure.

The disclosure above has mainly been related to high voltage application. It should however be realized that it is not limited to this field of application. The armature and the actuator may for instance be used also for low or medium voltage applications. Further, the armature and the actuator are not limited to use in switch devices such as circuit breakers or current interrupters, but may also be used in e.g. the field of robotics, safety applications in the car industry, etc.

The invention claimed is:

1. An armature for an electromagnetic actuator, the armature comprising:

an armature body comprising a cellular structure, a magnetic field generator including a repulsion coil, at least one electrically conductive member configured for cooperation with the magnetic field generator, a connection end configured for connection of the armature to an apparatus operable by an electromagnetic actuator, wherein the electrically conductive member is a separate member attached to the armature body, wherein the armature body comprises a connection part configured as a channel in the armature body and said channel having an opening at the connection end of the armature, wherein the connection part is configured for connection of the armature to the apparatus operable by the electromagnetic actuator, and wherein said channel has a channel wall that forms part of an armature housing.

2. The armature according to claim 1, wherein the cellular structure comprises cells, each cell defining a hollow area having a longitudinal dimension and a lateral dimension, wherein the longitudinal dimension extends in a direction away from the electrically conductive member.

3. The armature according to claim 2, wherein the cellular structure includes cellular walls configured to take up and/or distribute forces and stresses within the armature.

4. The armature according to claim 2, wherein the armature is configured to be movable in at least one direction of movement, and wherein the cellular structure includes cellular walls extending in the at least one direction of movement.

5. The armature according to claim 2, wherein the cellular structure is a honeycomb structure.

6. The armature according to claim 2, wherein the armature body includes the armature housing configured to at least partly surround the cellular structure.

7. The armature according to claim 6, wherein the at least one electrically conductive member is at least partly embedded in the armature housing.

8. The armature according to claim 2, wherein the armature body has a central axis and a delimiting external contour, and wherein, for at least a portion of the armature body, a distance between the central axis and the external contour decreases in an axial direction towards the connection end of the armature.

9. The armature according to claim 2, wherein the armature body has at least one side that has a flat portion that is perpendicular to a central axis of the armature and wherein the at least one electrically conductive member is located on or in said flat portion.

10. The armature according to claim 2, comprising two electrically conductive members configured for cooperation with the magnetic field generator, wherein the armature has two opposing sides that each have a respective flat portion perpendicular to a central axis of the armature, and wherein the two electrically conductive members are located on or in the respective flat portions.

11. The armature according to claim 3, wherein the armature is configured to be movable in at least one direction of movement, and wherein the cellular structure includes cellular walls extending in the at least one direction of movement.

12. The armature according to claim 3, wherein the cellular structure is a honeycomb structure.

13. The armature according to claim 3, wherein the armature body includes the armature housing configured to at least partly surround the cellular structure.

14. The armature according to claim 3, wherein the armature body has a central axis and a delimiting external contour, and wherein, for at least a portion of the armature body, a distance between the central axis and the external contour decreases in an axial direction towards the connection end of the armature.

15. The armature according to claim 3, wherein the armature body has at least one side that has a flat portion that is perpendicular to a central axis of the armature and wherein the at least one electrically conductive member is located on or in said flat portion.

16. An electromagnetic actuator comprising:

an armature including:

an armature body comprising a cellular structure, at least one electrically conductive member, a connection end configured for connection of the armature to an apparatus operable by the electromagnetic actuator, wherein the electrically conductive member is a separate member attached to the armature body, wherein the armature body comprises a connection part configured as a channel in the armature body and said channel having an opening at the connection end of the armature, wherein the connection part is configured for connection of the armature to the apparatus operable by the electromagnetic actuator, and wherein said channel has a channel wall that forms part of an armature housing, at least one magnetic field generator including a repulsion coil, wherein the electrically conductive member is configured for cooperation with the magnetic field generator, and an electricity source connectable to the magnetic field generator.

17. A switch device comprising:

at least a first electric contact element and a second electric contact element which can be selectively connected and disconnected with each other such that when the first and second contact elements are connected the switch device is closed, and when the first and second contact elements are disconnected the switch device is opened, and wherein one of said contact elements is movable, an electromagnetic actuator including:

an armature having:

an armature body comprising a cellular structure, at least one electrically conductive member, po3 a connection end configured for connection of the armature to an apparatus operable by the electromagnetic actuator, wherein the electrically conductive member is a separate member attached to the armature body, wherein the armature body comprises a connection part configured as a channel in the armature body and said channel having an opening at the connection end of the armature, wherein the connection part is configured for connection of the armature to the apparatus operable by the electromagnetic actuator, and wherein said channel has a channel wall that forms part of an armature housing, at least one magnetic field generator including a repulsion coil, wherein the electrically conductive member is configured for cooperation with the magnetic field generator, and an electricity source connectable to the magnetic field generator, a pullrod having a first end connected to the connection end of the armature of the electromagnetic actuator and having a second end connected to the movable contact element such that opening or closing of the switch device is controllable by the electromagnetic actuator.

* * * * *